United States Patent [19]

Moore et al.

[11] Patent Number: 4,512,442

[45] Date of Patent: Apr. 23, 1985

[54] METHOD AND APPARATUS FOR IMPROVING THE SERVICING OF AN ELEVATOR SYSTEM

[75] Inventors: William H. Moore, Bridgewater Township, Somerville County, N.J.; Alan F. Mandel, Scott Township, Allegheny County, Pa.; William J. Trosky, Wilkinsburg, Pa.; Kenneth M. Eichler, North Versailles, Pa.; Stephen P. Tomas, West Mifflin, Pa.; Edward Tober, Bethel Park, Pa.; Thomas A. Vasold, Morristown, N.J.

[73] Assignee: Westinghouse Electric Corp., Pittsburgh, Pa.

[21] Appl. No.: 595,174

[22] Filed: Mar. 30, 1984

[51] Int. Cl.[3] ..... B66B 3/00

[52] U.S. Cl. ..... 187/29 R; 340/19 R

[58] Field of Search ..... 187/29; 340/19, 21; 364/436, 580

[56] References Cited

U.S. PATENT DOCUMENTS

| | | | |
|---|---|---|---|
| 3,209,324 | 9/1965 | Diamond et al. | 340/19 |
| 3,781,901 | 12/1973 | Morrison | 340/21 X |
| 3,961,688 | 6/1976 | Maynard | 187/29 R |
| 3,973,648 | 8/1976 | Hummert et al. | 187/29 R |
| 4,002,973 | 1/1977 | Wiesendanger et al. | 187/29 R X |
| 4,106,593 | 8/1978 | Otto et al. | 187/29 R |
| 4,330,838 | 5/1982 | Yoneda et al. | 187/29 R X |
| 4,370,717 | 1/1983 | Hummert et al. | 187/29 R X |
| 4,401,192 | 8/1983 | Trosky et al. | 187/29 R |
| 4,418,795 | 12/1983 | Trosky et al. | 198/29 R |
| 4,458,788 | 7/1984 | Le Pore | 187/29 R |

FOREIGN PATENT DOCUMENTS 49-134044 12/1974 Japan .

OTHER PUBLICATIONS

Article "Elevatoring is Spoof-Proof at Security Pacific" in *Buildings Magazine,* Apr. 1984, pp. 74 and 75.

"Using the Computer in Elevator Maintenance" by D. Balk, *Elevator World,* Aug. 1978, pp. 20, 21 and 23.

"Computerization for the Elevator Company Specializing in Maintenance" by M. Sybert, *Elevator World,* Jul. 1979, pp. 28–33, 38–40.

"A Data Logger for Lift Traffic Engineering" by E. McKay, *Elevator World,* Jan. 1980, pp. 20–22, 24–26.

*Primary Examiner*—S. J. Witkowski
*Assistant Examiner*—W. E. Duncanson, Jr.
*Attorney, Agent, or Firm*—D. R. Lackey

[57] ABSTRACT

Methods and apparatus for improving the servicing of an elevator system based upon the actual usage of its many functions. The usage of predetermined elevator system functions is monitored and data is collected relative thereto. Threshold and limit parameters are provided for the monitored functions, which parameters are periodically compared with the usage data. The reaching of a usage threshold parameter by a monitored function results in predetermined associated maintenance services being added to a maintenance due list. When a monitored function reaches its associated limit parameter, a need for scheduled elevator preventive maintenance is indicated for all of the maintenance services on the maintenance due list.

35 Claims, 17 Drawing Figures

ON SITE-SYSTEM 240

ON SITE-SYSTEM 267

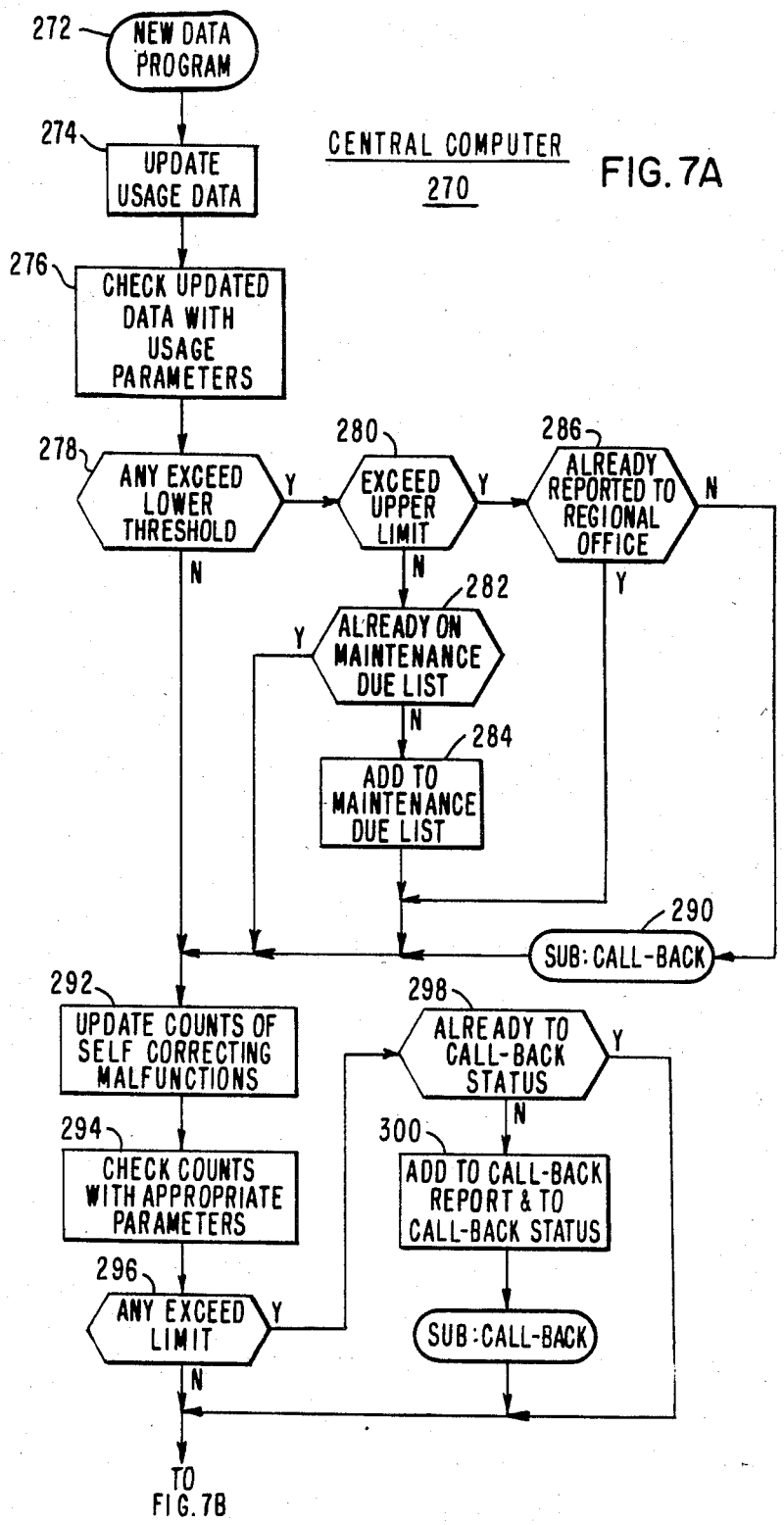
272
NEW DATA PROGRAM
274
UPDATE USAGE DATA
CENTRAL COMPUTER
270
FIG. 7A
276
CHECK UPDATED DATA WITH USAGE PARAMETERS
278
ANY EXCEED LOWER THRESHOLD
Y
N
280
EXCEED UPPER LIMIT
Y
N
286
ALREADY REPORTED TO REGIONAL OFFICE
N
Y
282
ALREADY ON MAINTENANCE DUE LIST
Y
N
284
ADD TO MAINTENANCE DUE LIST
290
SUB: CALL-BACK
292
UPDATE COUNTS OF SELF CORRECTING MALFUNCTIONS
294
CHECK COUNTS WITH APPROPRIATE PARAMETERS
296
ANY EXCEED LIMIT
Y
N
298
ALREADY TO CALL-BACK STATUS
Y
N
300
ADD TO CALL-BACK REPORT & TO CALL-BACK STATUS
SUB: CALL-BACK
TO FIG. 7B

CENTRAL COMPUTER
390

REGIONAL TERMINAL
420

REGIONAL TERMINAL
450

METHOD AND APPARATUS FOR IMPROVING THE SERVICING OF AN ELEVATOR SYSTEM

BACKGROUND OF THE INVENTION

1. Field of the Invention

The invention relates in general to elevator systems, and more specifically to methods and apparatus for improving the servicing of an elevator system.

2. Description of the Prior Art

The servicing of an elevator system is usually performed by scheduling routine visits by a mechanic to the job site, such as weekly or bi-weekly visits, depending upon the size of the elevator system. The mechanic performs certain preventive maintenance services during each visit on an elapsed time basis. In other words, certain services will be performed every 2 weeks, some every 4 weeks, others every 13 weeks, etc. Preventive maintenance, other than the scheduled services, may also be done, depending upon the mechanic's observations.

An elevator system includes many different functions, all of which must be operating up to specification, or the elevator service may be degraded. For example, the average time to serve hall calls, and the longest waiting time for elevator service, may be longer than necessary. Until the deterioration of elevator service reaches the point where it comes to the attention of the mechanic when making a preventive maintenance service call, or to the attention of proper personnel associated with the building who will contact the elevator service office, or until the item causing the service deterioration reaches the point where an observable malfunction or shutdown occurs, the deterioration of the elevator service will continue to deprive the building users of the quality service to which they are entitled. It is possible to detect performance deterioration by a performance evaluation, but since such studies usually require several personnel to visit the job site, and since they are time-consuming and costly, they are infrequent.

When a malfunction occurs which is detectable by the elevator users, or building management, and it is called to the attention of the elevator service office, the service office dispatches a mechanic to the job site. The problem, however, may have existed for some time before the proper person learns of it and makes a call to the service office. The mechanic will try to determine the "symptoms" reported to the service office, and he will also make independent observations to determine the exact nature and cause of the problem. Since the nature of the problem may pass through several people before reaching the service office, the information may be distorted and unreliable by the time it reaches the mechanic. Thus, the mechanic is usually on his own in determining the cause of the deterioration of elevator service. Also, the problem may be intermittent, or it may be cleared by some other means before the mechanic arrives, leaving no way for the mechanic to positively determine the cause of the problem. Troubleshooting with little and/or inaccurate information is time-consuming and, therefore, costly.

SUMMARY OF THE INVENTION

Briefly, the present invention relates to new and improved methods and apparatus for servicing elevator systems which include on-site microcomputer-based monitoring apparatus which continuously monitors predetermined elevator system functions while collecting and storing data related to the actual usage of the monitored functions. The on-site microcomputers have access to a central computer via an auto-answer, auto-dial modem and the commercial telephone system. The central computer may be similarly accessed by any desired number of other elevator systems in the same general area.

The central computer, which may be located at any desirable physical location, may be a minicomputer with bulk storage for long-term records, and a data base management system for decision making. The central computer has modems for access to the elevator systems under its supervision, as well as for communicating with a regional service office, via the commercial telephone system.

The regional service office has a terminal which includes a modem, through which the service dispatcher can receive messages from, and request information from, the central computer. The terminal includes a display, as well as a printer for making permanent records and reports for presentation to the management of the buildings whose elevator systems are serviced.

The on-site computers include logic for detecting the status of items which may cause full or partial shutdown of the associated elevator system, they have logic for detecting predetermined self-correcting malfunctions, and logic for detecting the deterioration of predetermined elevator system functions. Whenever the on-site logic detects a situation which requires immediate notification to the regional service office, an on-site computer dials the central computer and makes a detailed report of the problem, identifying any specific cars and/or floors involved, and the exact nature of the problem.

The central computer dials the regional service office whenever it receives a message from an on-site computer that requires immediate action. The central computer also includes logic for detecting long-term deterioration, and it may thus call the service office when its own logic determines that some function of the elevator system needs immediate attention.

The central computer also automatically dials out to each on-site computer once each day to collect all daily records made by the on-site computers. The central computer may also dial an on-site computer to relay the present status of an elevator system to the service office, when such information is requested by the service office. The central computer may also dial an on-site computer to relay the present status of the hall calls to the service office, when such information is requested by the service office.

The invention performs preventive maintenance by gathering informating relative to actual usage of predetermined elevator system functions, such as miles traveled by each elevator car, the number of starts and stops by each elevator car, the number of door operations at each floor of the building, the number of starts of the MG set, the MG running time, the number of notches by the floor selector, etc. The usage information is collected by the central computer on a daily basis. The central computer automatically dials the elevator systems under its jurisdiction, in sequence, receiving and storing all of the information collected by the elevator systems for the previous day. The central computer accumulates the data and checks the data relative to each monitored function against first and second parameters related to use. The first parameter is a usage threshold parameter related to when preventive maintenance services are required for certain elevator system components associated with the monitored function. When the usage of a monitored function reaches the first associated parameter, predetermined maintenance services associated with the use of the monitored function are added to a Maintenance Due List (MDL). When a monitored function reaches its usage threshold, the function monitored can be added directly to the MDL. In most instances, however, merely adding the monitored item to the MDL will not be sufficient to alert the mechanic as to all of the items requiring service. Thus, for most monitored items or functions there will be an associated servicing list stored in memory which details all items which should be serviced when the monitored function reaches its usage threshold. The second parameter is an upper usage limit. When a second usage parameter is reached for a monitored function, preventive maintenance should be scheduled for all maintenance services currently on the MDL, and the central computer will automatically report to the regional service office that such preventive maintenance should be scheduled, and it will send the MDL to the service office. In an alternate embodiment of the invention, the central computer will also send the MDL to the associated elevator system site.

Wnen the regional service office assigns the work on the MDL to a mechanic, the regional service office will indicate the fact that a mechanic has been assigned to the central computer. The central computer may assume that the work will be performed, and it may immediately reset the associated usage data. Alternatively, when the central computer sends the MDL to the elevator system site, the elevator mechanic may access the MDL with a hand-held plug-in terminal. The mechanic may indicate which service items on the MDL have been performed, and when this information is sent to the central computer, the central computer may then reset the associated usage data. Thus, the present invention improves elevator service by scheduling preventive maintenance operations depending upon actual usage of the various components of the system, as opposed to elapsed time scheduling which has no direct accurate relationship to actual usage of the elevator system.

The invention also detects deterioration of many elements of the elevator system by monitoring for misoperations which may be self-correcting and intermittent. These include selector misoperations, or the selector getting out of step, off-level landings, emergency dispatching, emergency stops, and the like. The numbers of such misoperations which occur in a predetermined period of time are compared with daily parameters stored on-site, and with longer term parameters stored in the central computer. The central computer will obtain the reported malfunction detections in its daily poll for stored information. Either the on-site computer or the central computer may initiate a call for immediate elevator service (callback) along with a detailed reporting of the problem, should its logic determine that a predetermined self-correcting malfunction has reached the point where a mechanic should be immediately dispatched to check the problem.

The invention also detects deterioration of many elevator system components and functions by making predetermined performance measurements. For example, the on-site computer may measure the time required for the car door to open, the time required for the car door to close, landing time, the time to make a one-floor run, and the like. The central computer may use the daily data to make other performance measurements, such as calculating the car speed. Both the on-site computer and central computer are provided with parameters for comparing the measured performances, with either computer initiating a call for immediate elevator service, should the performance deteriorate to the point where it is warranted. Again, a complete report of the problem is provided. Thus, the present invention improves greatly upon the usual ways of detecting deterioration of service, detecting such deterioration and reporting it long before the users of the elevator system and building management are even aware that a problem exists, and long before the deterioration would result in a shutdown of an elevator car.

The present invention also automatically performs troubleshooting by having the on-site computer monitor key causes for shutdown, such as fuses, and the elements which make up the various safety and protective circuits. When a monitored function does not match the correct parameter stored in the associated computer's memory, or it is outside a normal range established by upper and lower parameters, the on-site computer automatically dials the central computer, reporting car number, car position, and the nature of the problem. The central computer relays this information to the regional service office, and a mechanic is immediately dispatched to the job site.

It is a further feature of the invention that all items on the MDL are also automatically sent to the regional service office whenever an event triggers a request for immediate elevator service. Thus, while the mechanic is at the job site for the callback, he will also perform the maintenance due items on the MDL.

All decision making by the on-site computers, as well as by the central computer, is done with reference to parameters. This provides flexibility, allowing the regional service office to download new parameters to either or both the central and on-site computers, with no change in hardware.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIGS. 7A and 7B may be assembled to provide a flow chart of main or background program for the central computer, which maintains the long-term data records and includes logic for initiating callbacks and scheduled maintenance;

DESCRIPTION OF PREFERRED EMBODIMENTS

The present invention relates to methods and apparatus for improving the servicing of an elevator system. The specific functions and elements which are chosen for monitoring, and the specific hardware for performing the monitoring, are not critical to the invention and such details will not be included as it would unduly lengthen and complicate the specification. Examples will be given at the appropriate points of the description. Also, U.S. patents and U.S. patent applications which are assigned to the same assignee as the present application which disclose apparatus suitable for monitoring various elevator system functions and for providing appropriate data and signals responsive to such monitoring, are set forth in Table I. The commonly assigned U.S. patents and patent applications set forth in Table I, as well as those set forth in the description following Table I, are hereby incorporated into the present application by reference.

TABLE I

| FUNCTION | PATENT OR APPLICATION SERIAL NO. |
|---|---|
| Safety Circuits and Fuse | U.S. Pat. No. 4,418,795 |
| Speed Pattern | U.S. Pat. No. 4,161,235 |
| Doors | U.S. Pat. No. 3,814,214 |
| Hall Calls | U.S. Pat. No. 4,082,164 |
| Power Supply | U.S. Pat. No. 4,155,427 |
| Power Supply | U.S. Pat. No. 4,286,222 |
| Speed | U.S. Pat. No. 4,085,823 |
| Drive | U.S. Pat. No. 3,741,348 |
| Dispatcher | U.S. Pat. No. 4,046,227 |
| Dispatcher | U.S. Pat. No. 4,162,719 |
| Dispatcher | U.S. Pat. No. 4,397,377 |
| Terminal Slowdown | Appln. S.N. 524,811 Filed August 19, 1983 |
| Hall Lanterns | Appln. S.N. 527,919 Filed August 30, 1983 |
| Drive | Appln. S.N. 382,438 Filed May 26, 1982 |
| Emergency Stop | Appln. S.N. 370,021 Filed April 20, 1982 |
| Leveling | Appln. S.N. 409,687 Filed August 19, 1982 |

Figure 1:
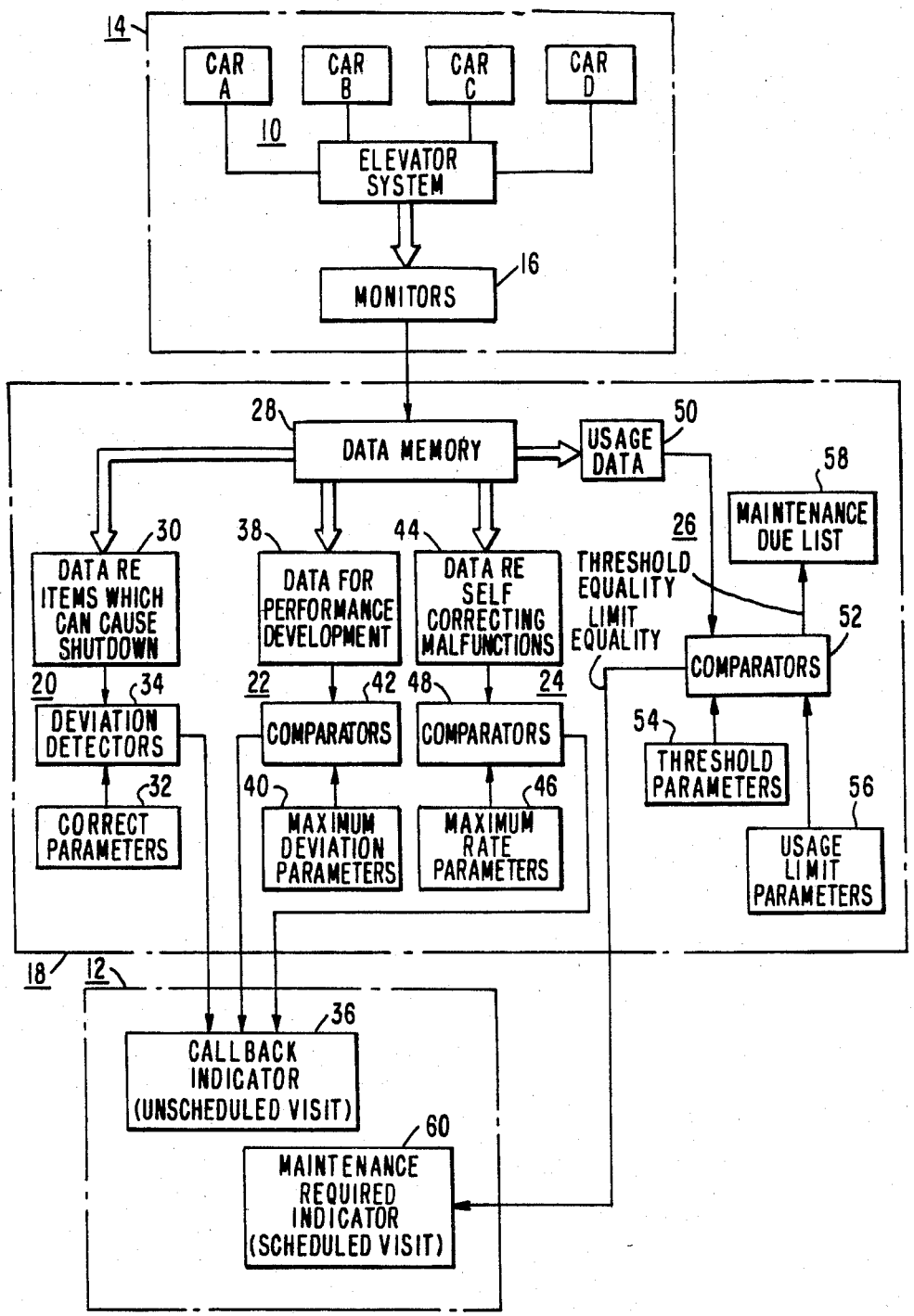
FIG. 1 is a block diagram of an elevator service arrangement constructed according to the teachings of the invention.

FIG. 1 is a block diagram of a new and improved elevator service arrangement, which includes an elevator system 10 to be serviced according to the teachings of the invention. The disclosed servicing arrangement is suitable for monitoring and servicing all of the elevator systems under the control of a regional service office, indicated generally at 12. Each elevator system site, such as site 14 associated with elevator system 10, includes monitoring means 16 for monitoring predetermined functions and elements of the elevator system 10, and for providing data in response to the monitoring. Data storage and data processing, including logic decision making relative to predetermined parameters, is shown generally within broken outline 18. While the functions shown within outline 18 may all be performed at one physical location with a single computer, in a preferred embodiment of the invention, the data storage, data processing, and decision-making functions are distributed between microcomputers located at site 14, and a central computer, such as a minicomputer, which may serve all of the elevator systems under the supervision of the regional service office 12. The central computer may be located at any desired location. Normally, but not necessarily, it will be located within the region serviced by the regional service office 12.

In general, there are four major areas of data evaluation. A first evaluation 20 monitors those items which can cause a shutdown of elevator service, and this function is preferably performed on site. Second and third areas of evaluation 22 and 24 monitor car and system performance, with the on-site and central computers sharing these areas. Any of these first three areas can initiate a call for immediate elevator service, with such an unscheduled service call being hereinafter referred to as a "callback". The fourth area of data evaluation, shown generally at 26 in FIG. 1, monitors the actual usage of the various electrical and mechanical elements of an elevator system subject to wear, with this function preferably being performed only by the central computer. This data evaluation function prepares a Maintenance Due List (MDL) based upon actual usage threshold parameters, and it also schedules preventive maintenance calls to the sites when actual usage of any one item reaches a usage limit parameter. If a callback occurs before the maintenance services on the MDL are taken care of by a scheduled maintenance visit, the MDL is given to the mechanic handling the callback. The usage data relative to the service items is reset, and the central computer removes all serviced items from the MDL.

As illustrated in FIG. 1, the first data evaluation function 20 draws data 30 from the computer memory, shown generally at 28, obtained by monitoring those items which can cause shutdown of an elevator car, or of the elevator system. Memory 28 represents data stored on site as well as at the central computer. Data 30 is compared with the correct parameters 32, also obtained from computer memory, in a comparison function 34. If a deviation is found, function 34 initiates a telephone call to the regional service office 12, providing a callback message 36 on the display associated with the regional computer terminal.

In like manner, the second data evaluation function 22 obtains data 38 from memory 28, and this data, related to car and system performance, is compared with maximum deviation parameters 40, also stored in memory 28, in a comparison function 42. If the performance of a function is found to be outside the maximum allowable limits, function 42 initiates a callback.

The third data evaluation function 24 obtains data 44 from memory 28 relative to self-correcting malfunctions or misoperations, and this data is compared with maximum rate parameters 46 in a comparator function 48. Should a malfunction occur at a rate which exceeds the associated parameter, function 48 initiates a callback.

The fourth evaluation function 26 obtains data 50 from memory 28 relative to actual usage of the elevator system, and a comparator function 52 compares the data with first and second parameters 54 and 56. The first parameter is related to usage threshold. When the usage of a monitored function reaches a threshold parameter, the maintenance services which should be performed because of this usage are placed on the MDL 58. When the usage of a monitored function reaches its associated second parameter, which is a usage limit parameter, it indicates that preventive maintenance should be scheduled, and an appropriate message 60 is provided on the display of the computer terminal at the regional service office. All items presently on the MDL are included in the display. The regional service office assigns a mechanic to visit the job site to perform the maintenance services listed in the MDL. The central computer may reset the MDL and associated usage data upon notification from the regional service office that a mechanic has been assigned, or it may wait until the mechanic inputs the specific work performed into the system, as desired. In one embodiment of the invention, the central computer additionally sends the MDL to the job site, and it is available to the mechanic via a plug-in hand-held terminal. The mechanic can also input the work that he has actually performed to the system, via the hand-held plug-in terminal, and when this information reaches the central computer in its daily collection of data from the job sites, it may then reset the associated usage data, as well as clearing the serviced items from the MDL.

Figure 2A:
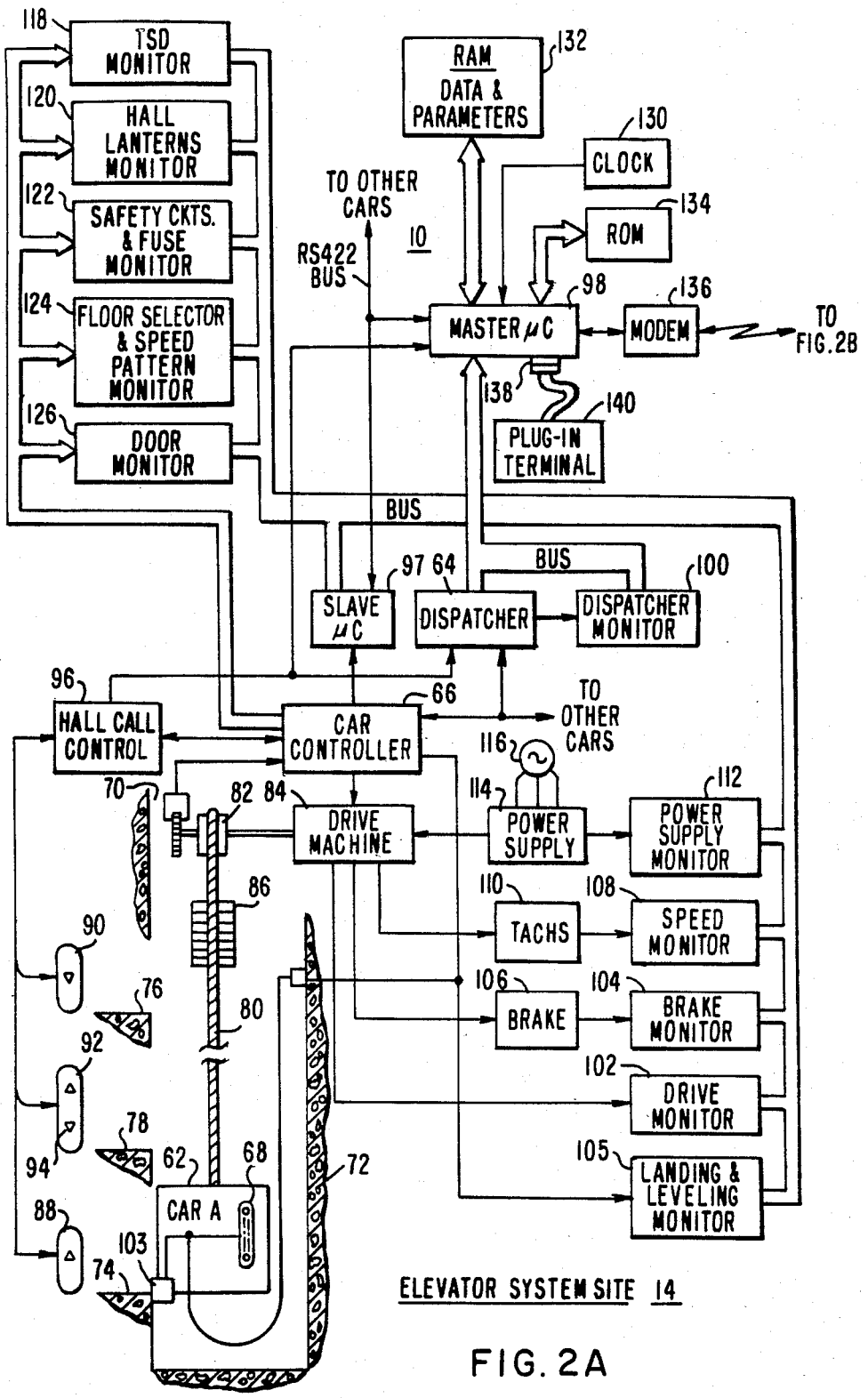
FIGS. 2A and 2B may be assembled to provide a detailed schematic and block diagram of an elevator system and apparatus for more efficiently servicing the elevator system.
Figure 2B:
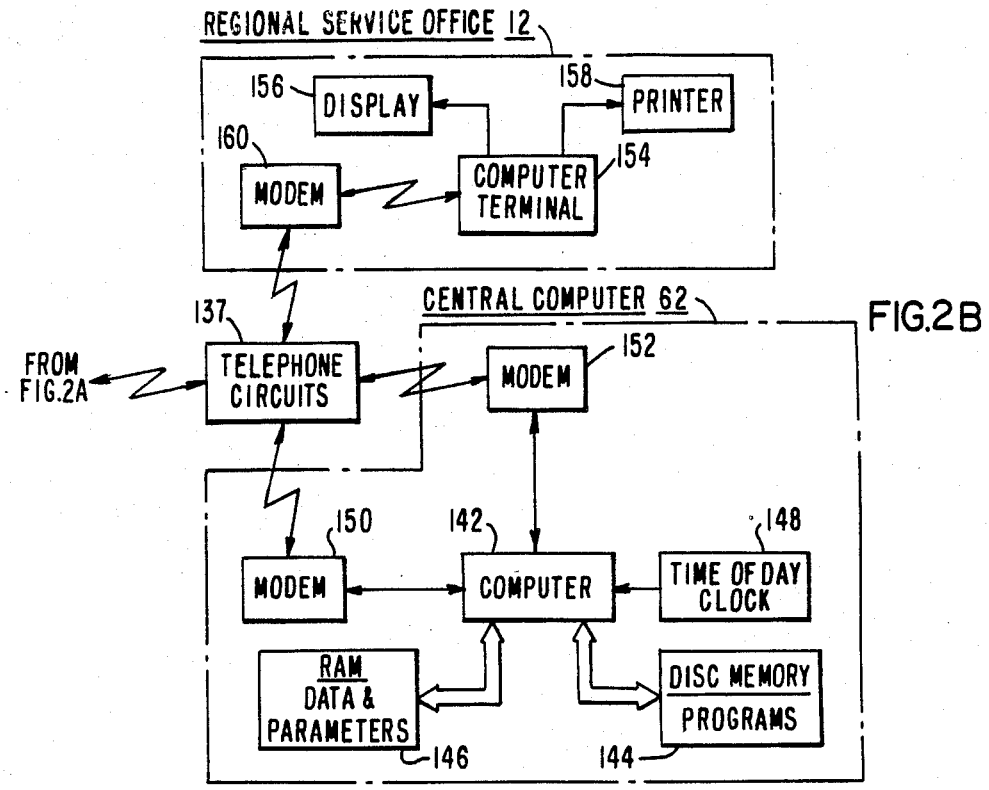

FIGS. 2A and 2B may be assembled to provide a more detailed schematic and block diagram of an elevator servicing arrangement for elevator system 10. FIG. 2A sets forth the on-site apparatus, and FIG. 2B sets forth the central computer 62 and regional service office 12.

The on-site apparatus 14 includes the elevator system 10. Since the specific details of the elevator system being monitored are immaterial to the claimed invention, elevator system 10 is shown in block form. U.S. Pat. Nos. 3,256,958; 3,741,348; 3,902,572 and 4,007,812 all set forth relay-based elevator systems which may be monitored, for example. U.S. Pat. No. 3,750,850; 3,804,209 and 3,841,733 collectively set forth a solid-state elevator system which may be monitored. Elevator system 10 may include a single elevator car 62, or a plurality of elevator cars under group supervisory control or group dispatcher 64. The elevator cars may be hydraulically driven, or they may be of the electric traction type. For purposes of example, a traction elevator system is illustrated, with only one elevator car 62 associated with car controller 66 being shown, as the other elevator cars would be similar. Car controller 66 includes a floor selector and speed pattern generator. A car station in elevator car 62 includes a push button array 68 for registering car calls.

The elevator cars are mounted for movement in a building to serve the floors therein. For example, elevator car 62 is mounted in a hoistway 70 of a building 72 having a plurality of floors or landings, with only the lowest floor 74, the highest floor 76, and one intermediate floor 78, being shown in FIG. 2A.

Elevator car 62 is supported by a plurality of wire ropes, shown generally at 80, which are reeved over a traction sheave 82 driven by a traction drive machine 84. A counterweight 86 is connected to the other ends of the ropes 80.

Hall calls from the various floors are registered by pushbuttons mounted in the hallways adjacent to the floor openings to the hoistway. For example, the lowest floor 74 includes an up-direction push button 88, the highest floor 76 includes a down-direction push button 90, and the intermediate floor 78 includes up and down push buttons 92 and 94, respectively. Up and down hall calls are sent to hall call control 96, which memorizes the calls until they are reset. Hall call control 96 sends the hall calls to the group supervisory control or dispatcher 64.

The group supervisory control 64, using information provided to it from the various elevator cars relative to their positions and activity level, determines the allocation or assignment of the hall calls to the cars, according to a predetermined operating strategy.

The monitoring apparatus includes a microcomputer 97 for each elevator car, such as Intel's iSBC 80/24 TM single board computer. While it is practical for each elevator car's microcomputer to directly access the central computer, in a preferred embodiment of the invention, the on-site communications are handled by a separate microcomputer 98. It simplifies the communications with the central computer by using a microcomputer 98 as a master, and the car microcomputers, such as microcomputer 96, as slaves, all interconnected by an RS422 bus. The master microcomputer 98, in addition to handling communications, can handle the system data, as opposed to the car related data. For example, the master microcomputer 98 can receive data from the dispatcher 64, from the dispatcher monitoring apparatus 100, and it can time the hall calls and provide traffic analysis summaries, such as set forth in U.S. Pat. No. 4,401,192. Suitable dispatching apparatus which may be used for the monitoring function 100 is set forth in the U.S. Patents listed in Table I. Microcomputer 98 can also time the various system signals related to traffic peaks, such as up peak and down peak, and relate the peaks to the time of day.

The various functions monitored by the slave microprocessors associated with the elevator cars may include the car controller 66, with U.S. Pat. No. 4,317,506 setting forth a notching type floor selector, and U.S. Pat. No. 3,750,850, setting forth a solid-state floor selector. Additional monitoring functions include a drive monitor 102, a brake monitor 104 for determining the position of the brake 106 associated with the drive machine, a speed monitor 108 which may be responsive to tachometers 110, a power supply monitor 112 which monitors a power supply 114 and source 116 of electrical potential, a terminal slowdown monitor 118 which monitors the arrival of the elevator cars at the terminal floors, hall lantern monitors 120 for monitoring the lamps in the hall lanterns, as well as any other lamps associated with the elevator system that it is desirable to monitor, safety circuit and fuse monitor 122, which monitors the safety relay and all of the contacts which make up the serial string which controls the safety relay, a speed pattern monitor 124 which monitors the generation and magnitude of the speed pattern which controls the car speed, and a door monitor 126 which monitors the various functions associated with the car door and hatch doors.

The master microcomputer 98 may include the same type of microcomputer as the slave microcomputers. While not shown relative to the slave microcomputer 97, each microcomputer includes a clock 130, a random-access memory (RAM) 132 which stores the data collected and the decision parameters, and a read-only memory (ROM) 134 which stores the application programs. The master microcomputer 98 additionally includes an auto dial-auto answer modem 136 which enables the site 14 to communicate with the central computer 62 via any suitable communication means, such as the commercial telephone circuits 137. The master microcomputer 98 may also have a plug 138 for receiving a plug-in terminal 140. The plug-in terminal 140 may be used by a mechanic to read the MDL stored in RAM 132, and for entering information relative to the service work performed.

The central computer 62 shown in FIG. 2B includes a computer 142 which is powerful enough to handle the number of elevator systems for which it is responsible, such as a minicomputer. Central computer 142 includes a memory 144, such as disc storage, for storing the application programs, a memory 146 for storing data and decision parameters, an accurate time-of-day clock 148, and auto answer-auto dial modems 150 and 152 for communicating with the elevator system site 14 and with the regional service office 12, respectively, via the commercial telephone circuits 137.

The regional service office 12 includes a computer terminal 154, a display 156, a printer 158, and an auto-answer modem 160 for communicating with the central computer 62.

Figure 3:
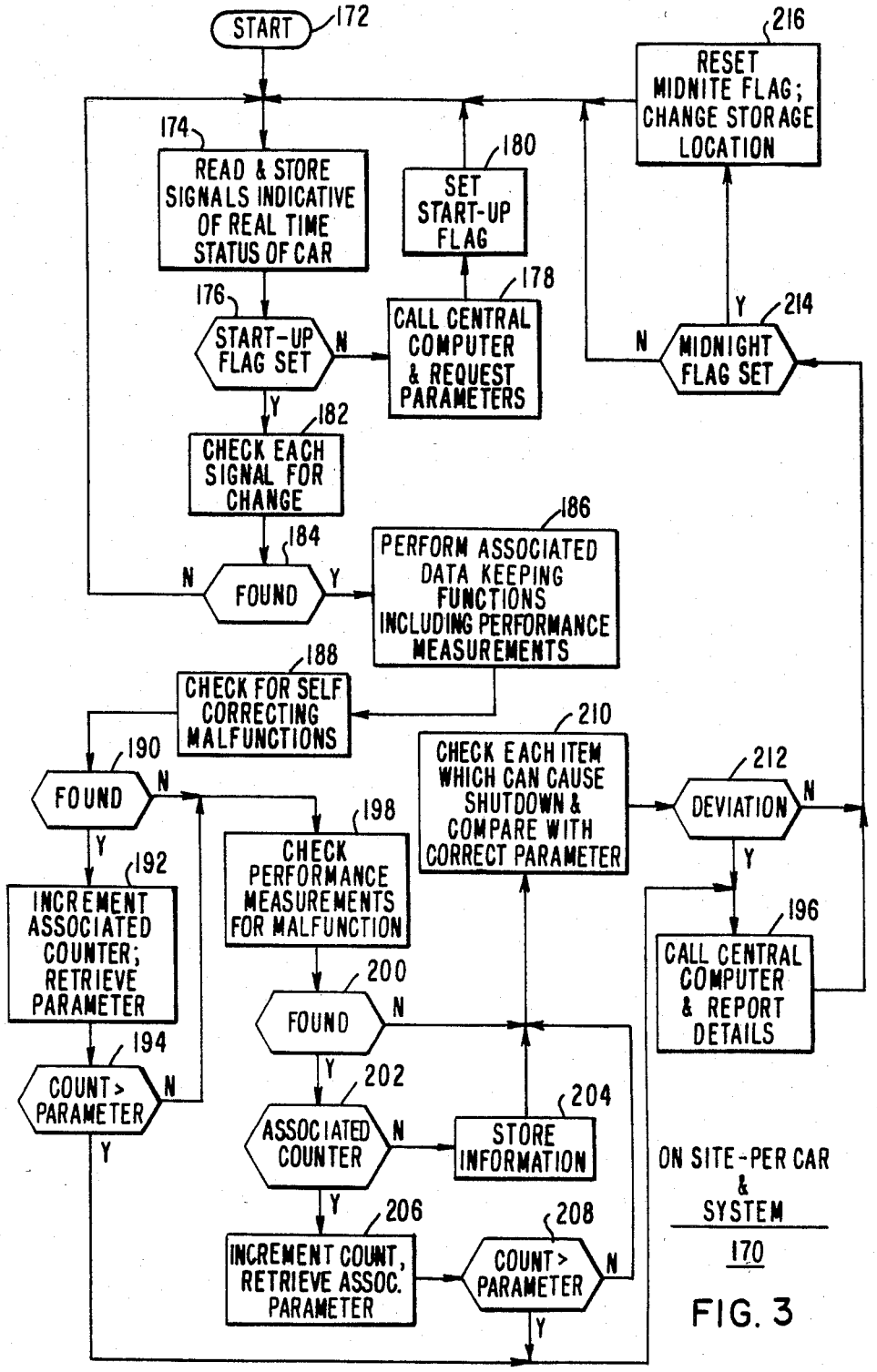
FIG. 3 is a flow chart of a program constructed according to the teachings of the invention which may be used for the data gathering and logic functions of the on-site computers.

FIG. 3 is a flow chart of a main or a background program 170 which may be used by the master microcomputer 98 shown in FIG. 2A to perform predetermined background tasks which are interrupted by higher priority tasks. When describing the flow charts in FIG. 3, as well as in the remaining Figures, the RAM maps set forth in FIGS. 14 and 15 will be referred to when appropriate. The slave microcomputer 97 would use a scaled-down version of the program shown in FIG. 3, and thus it is unnecessary to show and describe both programs in detail. Program 170 is entered at 172 and step 174 reads and stores all of the signals indicative of the real time status of the elevator cars, as well as inputs relative to all of the monitored items of the elevator system. Each slave microcomputer monitors such signals as the hand control signal which indicates the elevator car is on hand control, as opposed to automatic control, an M-G running signal, the car in-service signal, the car availability signal, the car next signal, the status of the overspeed relay, the car position signal, and the status of the up and down direction relays. The "present status" signals are stored in RAM, such as indicated at 470 in the RAM map of FIG. 14. In addition to these signals, most of which are available at the floor selector, the power supply monitor 112 monitors such things as each phase of the AC line voltage, the rectified voltage, fuses and grounds. The door monitor 126 monitors the opening and closing of the car doors, it detects car door "pumping", it detects a stalled car door, it checks opening and closing door speeds, it monitors the door safety edge, the door open button, the traffic sentinel and safety ray. The floor selector and speed pattern monitor 124 checks the selector to make sure that it resets properly at the upper and lower floors, it checks the selector for out-of-step and other misoperations, in both the up and down directions, and it checks the selector for nonoperation. The contacts responsive to the monitoring of the speed pattern may be in the safety circuits 122, as are the monitoring contacts of the drive monitor 132 and the monitoring of the terminal slowdown in monitor 118. The safety circuits 122 include the safety relay, and all of the monitored items which make up the series string which controls the safety relay. In addition to the items hereinbefore mentioned, the serial string may include the roof exit panel switch RE, the emergency stop switch ESS, the side exit switch SE, the overtravel switches UOT and DOT, the buffer switch BUF, and the governor switch GOV. The hall calls from hall call control 96 are also monitored and timed. The brake monitor 104 checks to make sure that the brake on the drive machine sets and lifts properly, and that the car does not run with the brake on. A leveling monitor 105 monitors the leveling operation of the elevator car, detecting poor landings, off-level landings, the floor or floors which are involved with improper leveling, and the travel directions involved. Lamps, such as hall lanterns, are monitored for burnout in the hall lantern monitor 120.

Figure 14:
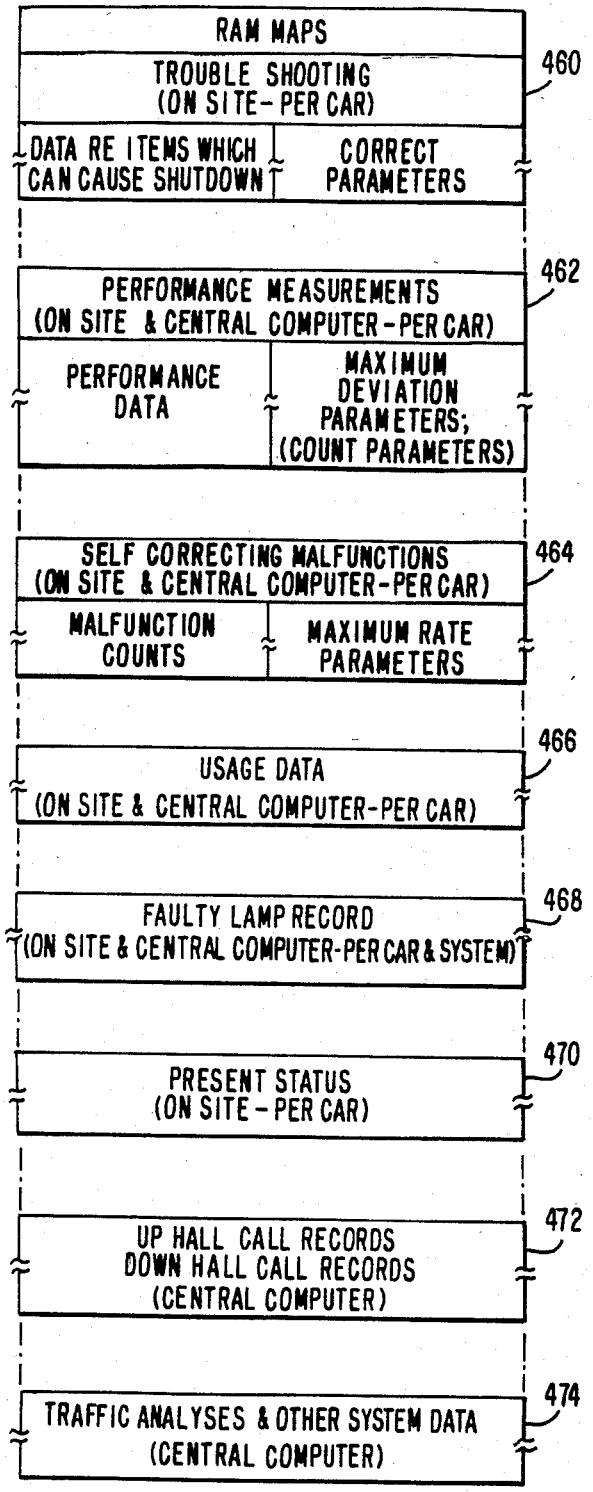
FIG. 14 sets forth RAM maps stored in RAM, listing the information stored on-site and/or at the central computer.
Figure 15:
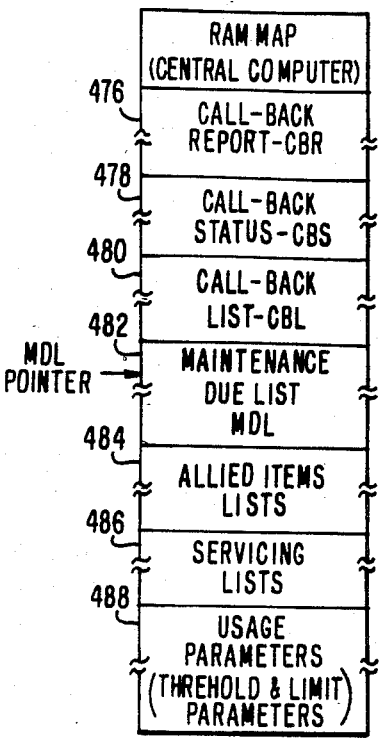
FIG. 15 is a RAM map setting forth the types of information stored in RAM at the central computer.

FIG. 14, at 468, sets forth a faulty lamp record, for maintaining the detection of burned out lamps.

After step 174 has read and stored all of the data, which may include both digital and analog data, and any processing of analog signals to place them in a form for comparison purposes, step 176 checks the start-up flag to determine if the elevator system is just starting up after a normal shutdown, or after an emergency shutdown, such as after the return of power following a power failure. If it is just starting, the start-up flag will not be set and step 178 calls the central computer 142 and requests the date, the time of day, and the various parameters to be used in the monitoring logic. The parameters include the number of floors in the building, the high and low limits which define acceptable ranges for the monitored voltages, the normal limits for car speed, the normal limits for the door opening and closing speeds, the count limits for such things as door pumping, floor selector notching failures, off-level stops, consecutive off-level stops, the time limits for such things as grounds, notching failures, safety edge, door stall, landing time, and the alert and callback limits for such things as grounds, rectified voltages, and line voltages. When the parameters have been received, step 180 sets the start-up flag to indicate that new parameters have been successfully received, and step 174 again reads the inputs. Step 176 will now find the start-up flag has been set, and step 182 checks each signal for a change. If no change has been detected in any of the signals, step 184 may immediately return to step 174, or step 174 may be periodically entered in response to a flag being set by a timer program, as desired.

When step 184 finds a change in the input data, step 186 calls the appropriate algorithm to process the change. The algorithm may simply store data, noting the time of day the change occurred, it may tabulate usage data, it may start a timer by setting a flag, stop a timer by resetting a flag, increment a count, and/or it may calculate the performance of an item, such as measuring door opening speed, door closing speed, calculating car speed as it passes between two floors at supposedly rated speed, and the like.

Step 186 advances to step 188 which checks the data for self-correcting malfunctions. For example, the door may pump a number of times and then correct itself, the car may land off-level and then correct itself, the car speed may be below or above the alert level, and then correct itself. Step 190 determines if any self-correcting malfunctions were found, and if there is an associated counter with the detected malfunction, step 192 may also increment the count, if it was not incremented by step 186. If the count refers to the number of occurrences in a predetermined period of time, such as the number of occurrences in a 15-minute time interval, step 192 may also set a timer flag to start a software timer in RAM, if the associated timer is not already active. Alternatively, the occurrences may be related to the time-of-day clock to determine the rate. Step 192 also retrieves any associated parameters from RAM. A RAM map 464 is shown in FIG. 14, which sets forth the format for storing malfunction counts and the maximum rate parameters applicable to each. Step 194 determines if the malfunction count exceeds the associated parameter. If it does, an elevator mechanic should be immediately assigned to correct the problem, and step 194 advances to step 196. Step 196 initiates the callback by automatically dialing the central computer 62, and once a communication link has been established, it reports the nature of the problem, the car involved, the floor involved, and the like. The central computer 62, in turn, will call the regional service office 12 and report the problem to the computer terminal 154.

If step 194 does not find that the self-correcting malfunction count has exceeded its associated parameter, step 194 proceeds to step 198 which obtains performance parameters from RAM (RAM map 462—FIG. 14), and it compares the performance measurements made in step 186 with the associated parameters. Step 200 determines if any performance is outside a callback limit. If so, step 202 checks to see if there is an associated software counter. If not, step 204 simply stores the information. If it has a counter, step 206 increments the count and it retrieves the count parameter from RAM. Step 208 determines if any count exceeds its associated callback parameter. If it does, step 208 proceeds to step 196 to dial the central computer and initiate a callback. If the count does not exceed the parameter, step 208 advances to step 210 which checks each item which can cause shutdown of an elevator car or of the elevator system. These items may be stored in RAM, as illustrated in FIG. 14. RAM map 460 of FIG. 14 sets forth the format for storing such data, and a place for storing the correct parameters is also indicated. Step 212 checks to see if there is a deviation from the associated parameter, or a deviation from the acceptable range. If so, step 212 advances to step 196, which initiates a callback to the central computer 62.

If step 212 finds no deviation sufficient to initiate a callback, it advances to step 214, as does step 196. Step 214 checks to see if a "midnight" flag has been set by the timer program 220 of FIG. 4. If so, the data gathering function for the day has been completed, the data is shifted into a new storage location, and the midnight flag is reset. Step 216 returns to step 174, as does step 214 when it does not find the midnight flag set.

Figure 4:
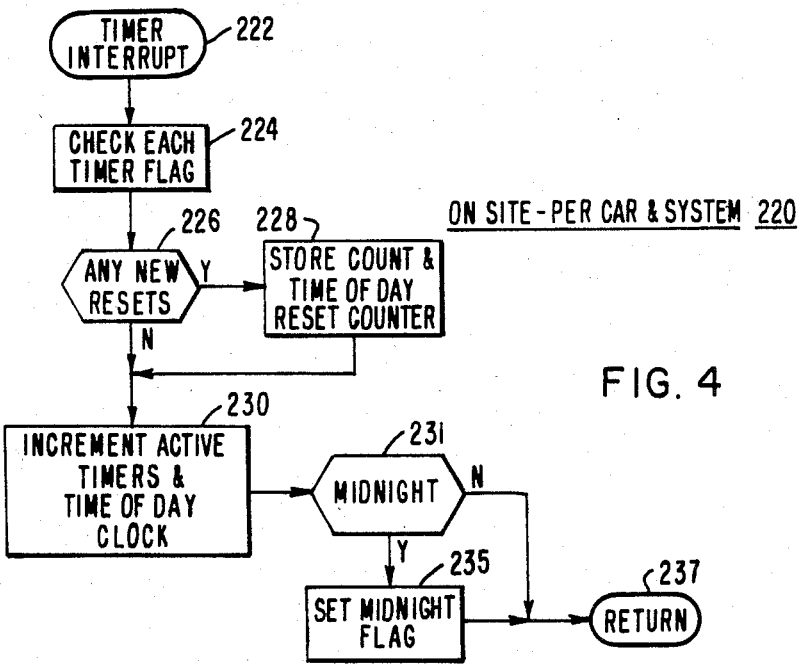
FIG. 4 is a flow chart of a timer interrupt program which may be used by an on-site computer to keep a time-of-day clock, and for maintaining active timers set by other programs.

The main program 170 shown in FIG. 3 is interrupted by a timer interrupt, such as a one second hardware timer interrupt, and the interrupt vectors the microcomputer to a starting address indicated at 222, to start timer program 220 shown in FIG. 4. Step 224 checks each software timer flag and step 226 checks for new resets of timer flags. Step 228 stores the count of any newly reset timers, and also the time of day at which the reset occurred. Step 228 advances to step 230, as does step 226 if no new resets are detected. Step 230 increments all active timers, including those which are found to be newly set, and it updates the time-of-day clock. Step 231 checks the time-of-day clock to see if it is midnight, and if so, step 235 sets the midnight flag referred to in step 214 of FIG. 3. Step 235 returns to the interrupted program at 237, as does step 231 when the "No" branch is taken.

Figure 5:
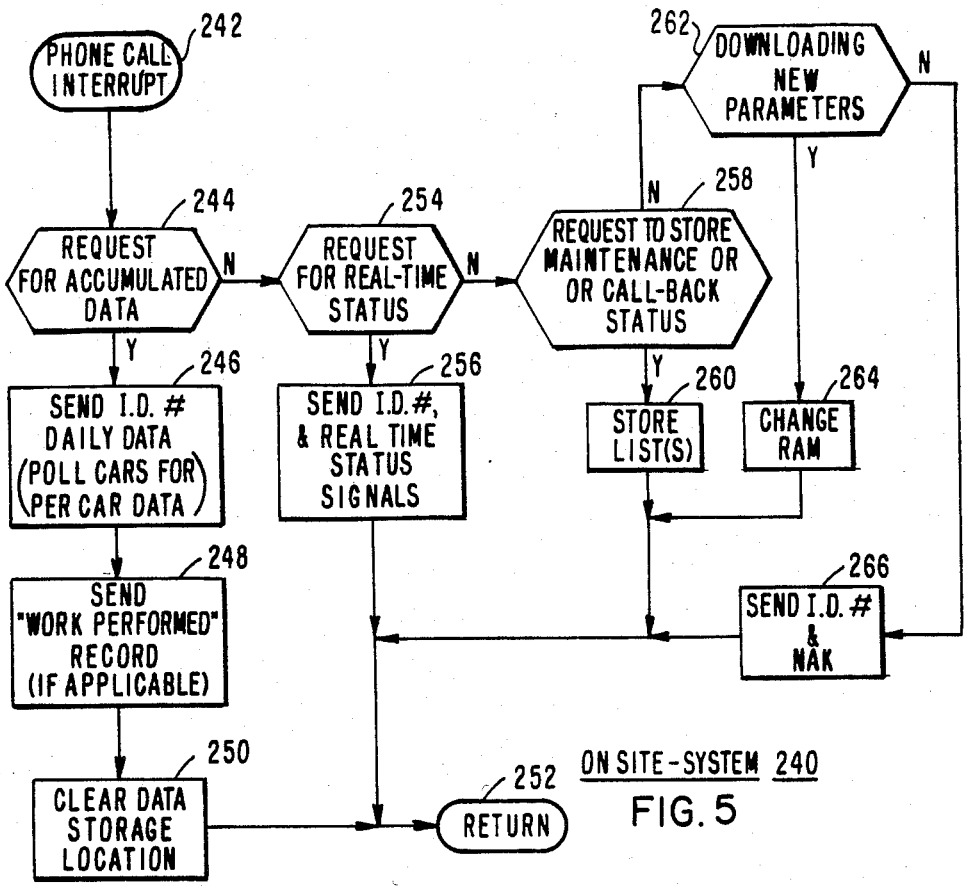
FIG. 5 is a flow chart of a phone call interrupt program which may be used by an on-site computer to handle telephone initiated requests from the central computer.

The main program 170 of FIG. 3 is also interrupted by a phone call from the central computer 142. A phone call interrupt runs program 240 shown in FIG. 5, which is entered at starting address 242 in ROM. The program first determines the reason for the interrupt, with step 244 determining if it is a request for daily data, which request occurs once each day after the midnight transfer of the data to a new storage location. If step 244 finds the interrupt to be a request for daily data, step 246 polls the slave microcomputers for per-car data, transferring it to the central computer, and it adds its own system data, including hall call data. As will be hereinafter explained, step 248 also sends a "work performed record" back to the central computer 142. In one embodiment of the invention, the mechanic, after servicing the elevator system, enters the work actually performed into the master microcomputer 98 via a hand-held plug-in terminal 140. This data is sent back to the central computer 142 in step 248. Step 250 may clear the daily data from the storage location, or it may be retained until the next day's data is moved into this location, as desired. Program 240 returns to the interrupted program at 252. Interrupts which may require a relative long time to complete, such as those which are trying to establish communication links via the telephone circuits, may be re-entrant, switching back and forth between the main and interrupt programs as required.

If step 244 does not find a request for daily data, step 244 advances to step 254 to determine if it is a request for real-time status. If it is, step 256 sends the ID number of the elevator site and the requested real time data. For example, the request may be for a memory read from specific, or all of the slaves, and/or it may be a request for the present status of the hall calls. Step 256 returns to the interrupted program at 252.

If step 254 does not find a request for real time status, step 254 advances to step 258 which checks to see if the interrupt is a request to store the MDL and/or the callback status CBS. The callback status CBS will be hereinafter described. In the embodiment which utilizes the hand-held terminal, the central computer 62 sends the MDL and CBS to the master on-site computer 98, and the mechanic can thus obtain the information on-site. If step 258 is a request to store such lists, step 260 receives and stores the information and the interrupt program 240 returns to the interrupted program at 252. If step 258 does not find a request to store lists, step 258 proceeds to step 262 which checks to see if it is a request to download new parameters. If so, step 264 stores the new parameters in RAM, such as shown in the RAM maps 460, 462 and 464 of FIG. 14. If step 262 is the last type of request which can be made, and it did not find a request to download new parameters, step 262 proceeds to step 266 which sends its ID number and NAK, indicating that it did not receive a proper message. Step 266 returns to the interrupted program at 252.

Figure 6:
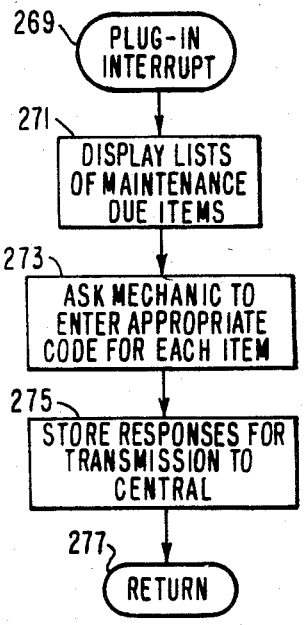
FIG. 6 is a flow chart of a plug-in interrupt program which may be used by an on-site computer for servicing requests and for receiving information from a mechanic at the job site.

As hereinbefore mentioned, in one embodiment of the invention the mechanic may access the master microcomputer 98 via a plug-in terminal 140 shown in FIG. 2A. When the hand-held terminal is plugged in, the mechanic enters an interrupt via its keyboard. An interactive program 267 shown in FIG. 6 is then entered at 269, and step 271 displays the MDL and/or CBS. After completing the service tasks, the mechanic will again access the master microcomputer 98 via the plug-in terminal, and the program will ask the mechanic, in step 273, to enter appropriate code for each item on the MDL and CBS. The code will indicate whether or not the work has been performed. Step 275 stores the mechanic's responses, for transmission to the central computer as the "work performed record" referred to in step 248 of FIG. 5. Program 269 returns to the interrupted program at 277.

Figure 7B:
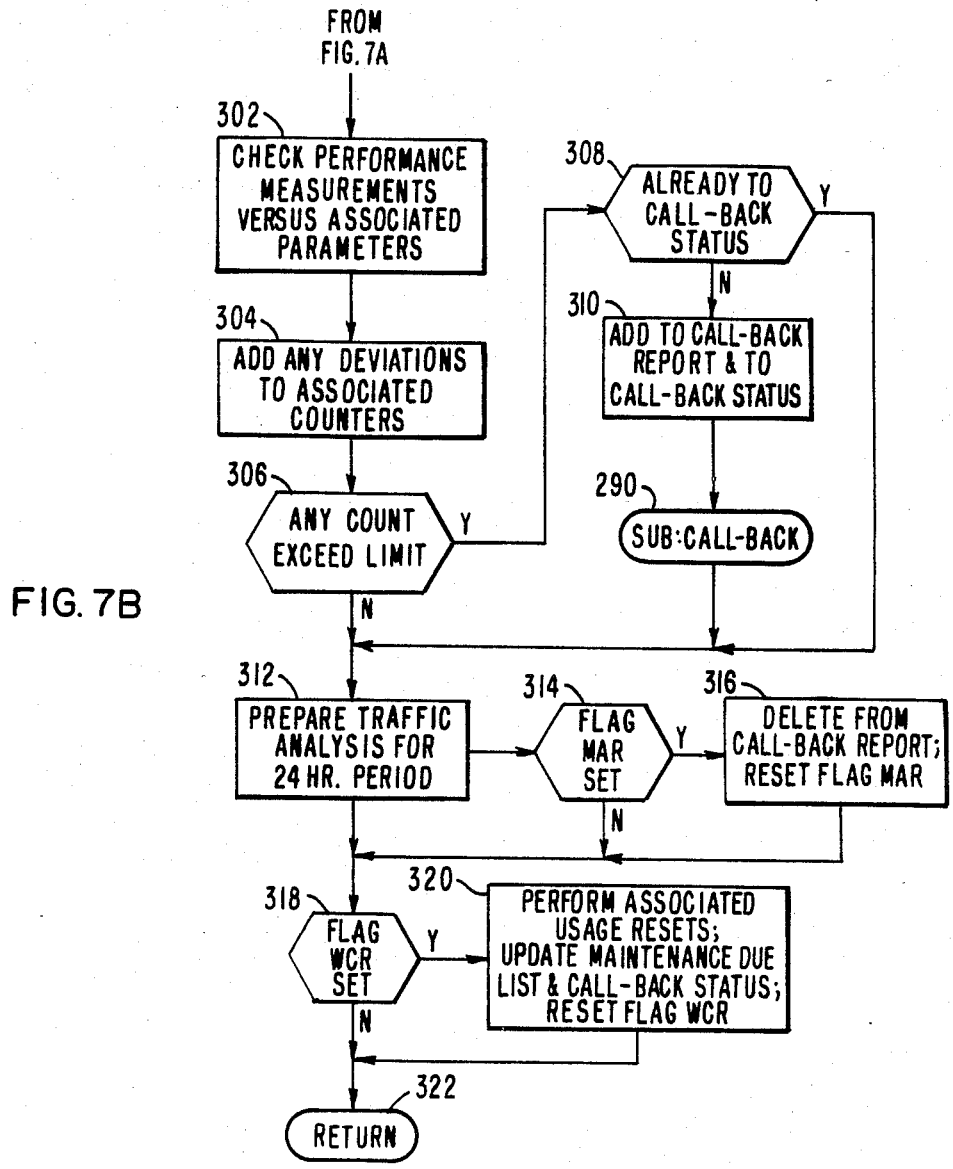

FIGS. 7A and 7B may be assembled to provide a program 270 for the central computer. Program 270, which may be run each time new daily data is collected, is entered at 272 and step 274 updates the usage data stored in RAM (RAM map 466—FIG. 14), calculating time, mileage, number of operations, and the like, when the usage data is not already in the desired format. The new usage data is then added to the usage data already stored in RAM from previous collections of daily data. Step 276 compares the up-dated usage data with the usage parameters (RAM map 488—FIG. 15), both the threshold parameters required to place an item on the MDL, and the limit parameters required to schedule maintenance for all the items on the MDL. Step 278 checks to see if any usage of any usage-monitored facet of the elevator system has exceeded the parameter which establishes its lower usage threshold. If an item is found which exceeds its threshold parameter, step 278 advances to step 280 which checks to see if any usage has exceeded its associated upper limit. If not, step 282 checks to see if the items to be serviced which are associated with the monitored function are already on the MDL. If not, step 284 adds it to the MDL and proceeds to step 292, as does step 282 when the item is found to already be on the MDL. Items monitored for usage will usually have associated servicing lists in RAM (RAM map 486—FIG. 15). When step 278 of FIG. 7A finds a monitored use exceeds the associated lower or threshold parameter, and step 280 finds the upper limit has not been exceeded, step 284 adds associated items from the associated servicing lists to the MDL. For example, if the monitored usage which was found to exceed the lower threshold is miles traveled by an elevator car, which may be determined by tracking car position and floor heights, the items added to the MDL would be those associated with car travel. These items, for example, may include: check traveling cable, hoist ropes, governor rope, and comp ropes; check MC brushes; lubricate sheaves; check guide rollers; service governor, etc. If the monitored usage which was found to exceed the usage threshold was the number of car door operations, the items added to the MDL, for example, may be: lubricate car door operator; adjust belt tension; check safety edge; check safety ray; check operating cables; check linkages, etc. Step 284, and the "YES" branch of step 282, proceed to step 292.

If step 280 finds an upper limit has been exceeded, step 286 checks to see if this has already been reported to the regional office 12. If not, step 286 calls a subroutine CALLBACK, indicated at 290 in FIGS. 7A and 7B, and shown in detail in FIG. 8. Step 286 proceeds to step 292 when it finds it has already reported the occurrence to the regional office, and the subroutine CALLBACK returns to step 292.

Step 292 updates the counts of self-correcting malfunctions. The on-site computers maintain the count over a 24-hour period, while the central computer 142 maintains the count over longer periods of time and can compare the counts with different thresholds to detect long-range problems. Step 294 checks the counts and compares them with appropriate parameters stored in RAM (RAM map 464—FIG. 14). Step 296 determines if any count has exceeded its parameter. If so, step 298 checks to see if the malfunction is already on the callback status list. As shown at 476, 478, and 480 in the RAM map of FIG. 14, there are three callback associated lists, called the callback report (CBR), the callback status (CBS), and the callback list (CBL). CBR displays a separate screen for each callback item that is active. Included with each callback description is the MDL. Thus, when a mechanic is assigned to a callback, the maintenance due list automatically accompanies it. The CBR includes all callbacks for which a mechanic has not yet been assigned. CBS produces a single screen with a scroll area in which a three-line summary of information is given for each active callback. Callback items stay on the CBS until the mechanic reports that the work has actually been done. The callback list CBL is similar to CBS, except it shows all callback items, active and inactive, whereas CBS shows only active callbacks. Thus, the callback list provides a permanent record of corrective actions taken for the associated elevator system.

If step 298 finds the callback is not already on CBS, step 300 adds the callback to both CBR and CBS and step 300 proceeds to call subroutine CALLBACK indicated at 290. The subroutine returns to step 302, as does step 298 when it finds the callback already on CBS.

Step 302 performs any necessary calculations to determine car and system performance, it obtains the maximum deviation parameters from RAM (RAM map 464—FIG. 14), and it compares the actual performance with the associated parameter. For example, on a run of an elevator car which is long enough for the car to reach full rated speed, the time between floor selector notches between predetermined floors may be collected as data, and knowing the distance between the notching indicia, the time may be accurately converted to car speed. Two maximum deviation parameters would be applicable, one for the low end of the normal speed range and one for the high end. Step 304 adds occurrences of any deviations beyond the normal range to an associated counter, if it is desired to count the number of deviations which occur over a predetermined period of time, or the percent of such deviations based on the number of runs may be calculated, etc. Step 306 retrieves the maximum count parameter from RAM (RAM map 462—FIG. 14) and determines if any exceeds the limit. If so, step 308 checks to see if the performance deviation is already on the callback status list CBS (RAM map 478—FIG. 15). If not, step 310 adds the item to the CBR (RAM map 476—FIG. 15) and to the CBS, and then calls subroutine CALLBACK at 290.

Step 306 proceeds to step 312, if the performances checked are all within acceptable limits, as does the "YES" branch of step 308. The subroutine CALLBACK, when called by step 310, also returns to step 312.

Step 312 prepares a traffic analysis for the 24 hour period and stores it in RAM (RAM map 474—FIG. 14). The traffic analysis, for example, may generate an up call summary and a down call summary with a resolution of 30 minutes. It would list the number of such calls answered in 0–30 seconds, 30–60 seconds, 60–90 seconds, greater than 90 seconds, and also the longest wait call, for each 30 minute period of the 24 hour period. It may also generate summaries which provide similar information for each floor.

Step 312 proceeds to step 314 to determine if the central computer 62 has received a Mechanic Assigned Report from the regional office 12. If such a report has been received, which may be checked by examining a flag MAR, step 316 deletes the associated callbacks from CBR (RAM map 476—FIG. 15). Step 316 proceeds to step 318, as does the "No" branch of step 314, with step 318 determining if a Work Completed Report has been received. This may be checked by examining a flag WCR. This report can be sent to the central computer 142 from the regional office 12, or from the master microcomputer 98 when entered by the mechanic via the plug-in terminal 140. If such a report has been received, step 320 resets the associated usage data in RAM (RAM map 466—FIG. 14), it removes the associated items from the MDL, it makes a permanent record of the services performed, and if a callback was involved, it removes the associated item, or items, from the CBS. Step 320 returns to a priority executive at 322, as does the "No" branch of step 318.

Figure 8:
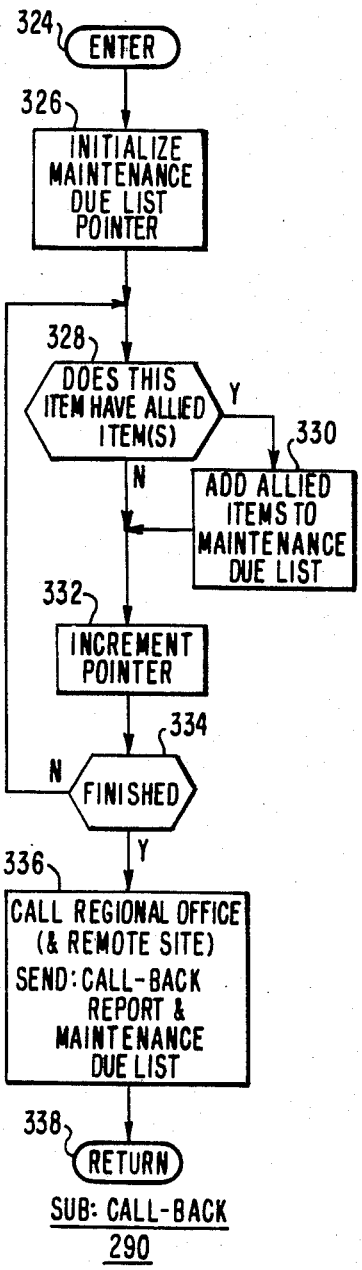
FIG. 8 is a flow chart subroutine CALLBACK, which is called by the program of FIGS. 7A and 7B when the central computer wants to report a need for immediate elevator service.

A flow chart for the subroutine CALLBACK, referenced 290 in FIGS. 7A and 7B, is set forth in FIG. 8. The subroutine is entered at 324 and step 326 initializes a pointer to the first item on the MDL (RAM map 482—FIG. 15). Step 328 checks an Allied Items List in RAM (RAM map 484—FIG. 15) to determine if other items should be added to the list because this particular item is on the MDL. Examples of allied items include those: (a) which require a special tool, (b) which require special access, (c) which require special or long preparation and (d) which require a mechanic with a special skill. If a special tool is required, all other items requiring the same tool may be added to the list, and when they have been serviced, their usage will be zeroed or reset in RAM (RAM map 466—FIG. 14). Special access, for example, may be an item which requires the mechanic to get on top of an elevator car, or to go into the pit of an elevator car. Once there, the mechanic should check and service other items in the same location. In like manner, if other items can be serviced as a result of the special or long preparation for an item, they should also be added to the MDL. If a mechanic with a specialized skill is required for an item on the MDL, the mechanic should also check all other items at that site which require the special skill.

If step 328 finds that an item on the MDL has an allied item, step 330 adds it to the MDL. Steps 330 and the "No" branch of step 328 both proceed to step 332 which increments the MDL pointer. Step 334 checks to see if the review of the MDL has been completed. If not, step 334 returns to step 328. If the MDL has been traversed, step 334 proceeds to step 336 which dials the regional office 12. Once communication has been established with the regional office 12, the central computer 62 sends the MDL, along with the callback report CBR, if the phone call is the result of a callback. If the elevator site has provisions for the plug-in terminal 140, step 336 would also dial the master microcomputer 98 and send the MDL and CBR to the master microcomputer. Step 336 returns to the interrupted program at 338.

Figure 9:
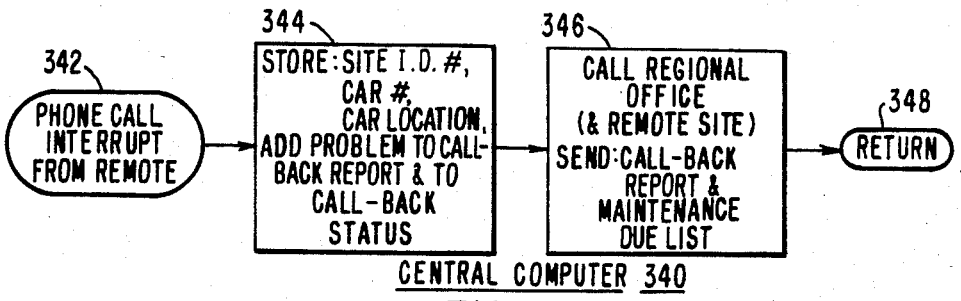
FIG. 9 is a flow chart of a phone call interrupt program which may be used by the central computer when it receives a phone call from an on-site computer.

FIG. 9 is a flow chart of an interrupt program 340 which sets forth the functions involved at the central computer 62 when the master microcomputer 98 dials the central computer with a callback report. The interrupted program is entered at 342 and step 344 stores the site ID number, the car number involved, and its floor location, if pertinent, as well as any pertinent system data, and it adds the nature of the problem with as many details as desired to the CBR and CBS (RAM maps 476 and 478—FIG. 15). Step 344 proceeds to step 346 which calls the regional office 12 and sends the CBR and MDL. Step 346 also sends the same information to the master microcomputer 98, if applicable. Step 346 returns to the interrupted program at 348.

Figure 10:
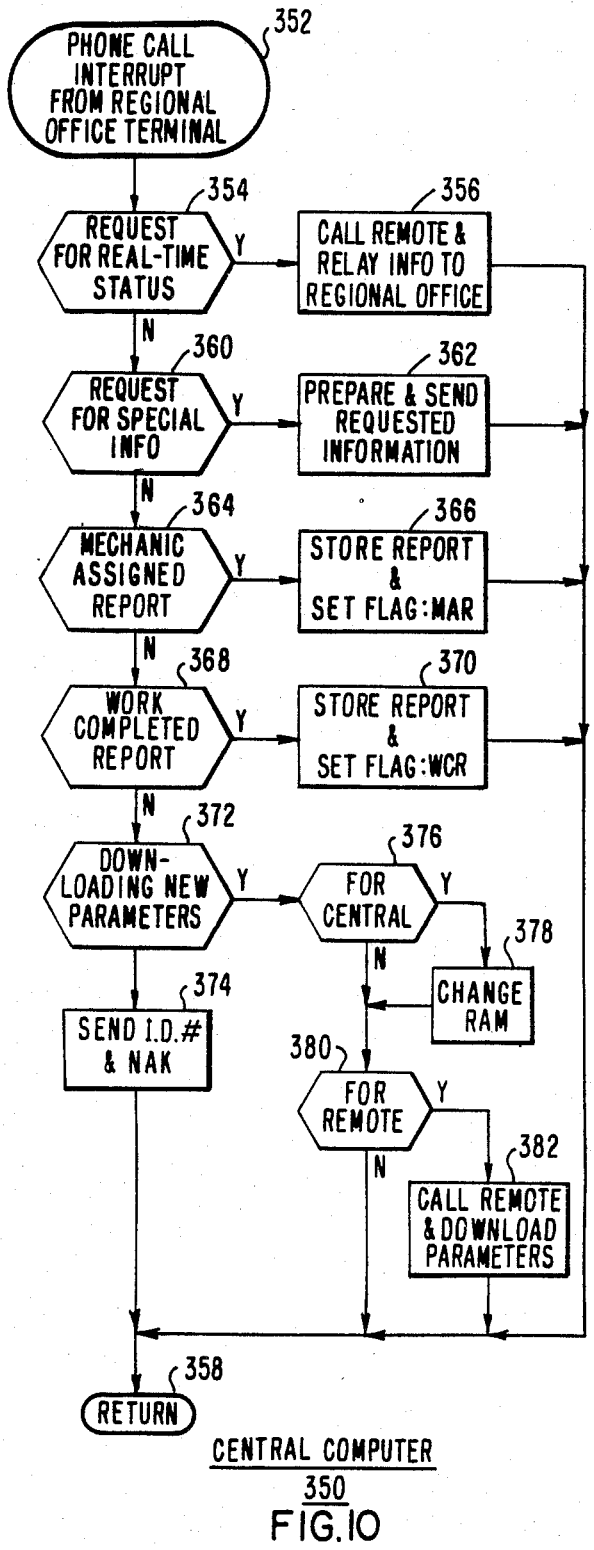
FIG. 10 is a flow chart of a phone call interrupt program which may be used by the central computer when it receives a phone call from the regional service office.

FIG. 10 is a flow chart of an interrupt program 350 which sets forth the functions involved at the central computer 142 when the central computer receives a phone call interrupt from the terminal 154 located at the regional service office 12. The interrupt program 350 is entered at 352 and step 354 checks to see if the regional office is requesting the real time status of an elevator system under its jurisdiction. If so, step 356 calls the elevator system involved in the request, and the master microcomputer 98 relays the requested information from the pertinent slave microcomputer 97 for a slave "memory read", and from the memory of the master microcomputer 98 for a reading of hall calls. The interrupt program 350 returns to the interrupted program at 358. The real time status is actually provided on a reentrant basis, at a rate which follows system changes with no apparent or significant delay.

In like manner, step 360 checks to see if it is a request for special information, and step 362 sends the requested information. Step 364 checks to see if the regional office 12 is sending a Mechanic Assigned Report. If so, step 366 stores the report and sets the flag MAR, which flag is checked in step 314 of FIG. 7B. Step 368 checks to see if the regional office is sending a Work Completed Report. If so, step 370 stores the report and sets flag WCR. Flag WCR is checked in step 318 of FIG. 7B. Step 372 checks to see if the regional office 12 wishes to download new parameters. If so, step 376 checks to see if the parameters are for the central computer 62. If so, step 378 changes the associated parameters in RAM (RAM map 488—FIG. 15; RAM maps 462 and 464—FIG. 14). Step 378 and the "No" branch of step 376 proceed to step 380 to determine if the changed parameters affect a master microcomputer at an elevator site. If so, step 382 calls the elevator site involved and downloads the new parameters. Step 382 and the "No" branch of step 380 return to the interrupted program at 358.

Figure 11:
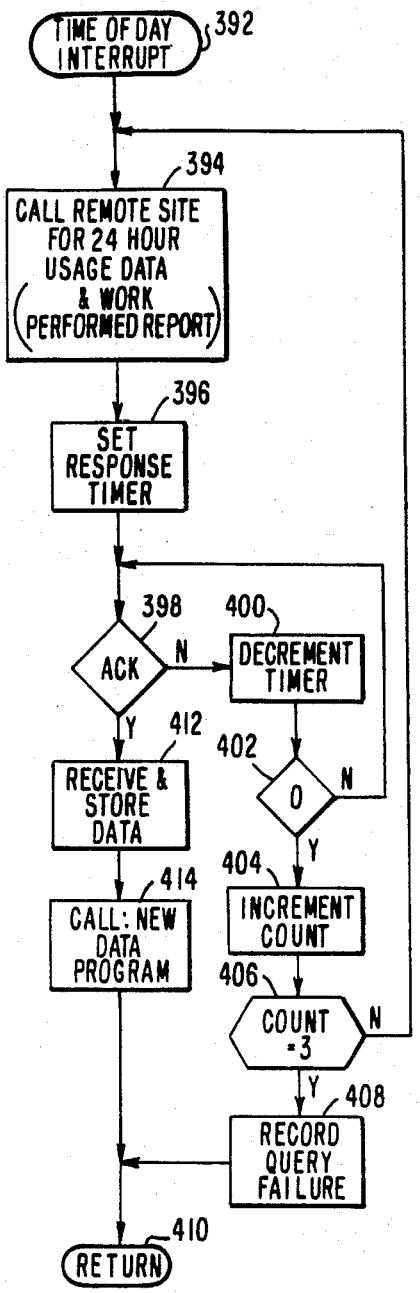
FIG. 11 is a flow chart of a time-of-day interrupt program which may be used by the central computer to obtain the daily data from the elevator sites.

FIG. 11 is a flow chart of a program 390 which may be run as a result of a time-of-day interrupt, for example after midnight, in order to obtain the daily data from the various elevator systems under the supervision of the central computer 62. Program 390 is entered at 392 and step 394 calls the master microcomputer 98 and asks for the daily data for the last 24 hour recording period. Step 394 will also ask for a Work Performed Report, if the site called has provisions for a plug-in terminal 140. The following format may be used for all telephone calls, with the format only being shown in this particular figure in order to simplify the drawings. After step 394 places the telephone call, step 396 sets a software response timer. Step 398 checks to see if the called station has responded. If no response has been received, step 400 decrements the response timer and step 402 checks to see if the response timer has timed out. If it is still active, step 402 returns to step 398. If it has timed out, step 402 proceeds to step 404 which increments a dial-out count. Step 406 checks to see if this count has reached some predetermined number, such as three. If it has not, step 406 returns to step 394 to again dial the selected site. If the count has reached three, step 406 proceeds to step 408 which records the query failure. Step 408 returns to the interrupted program at 410.

If step 398 finds an acknowledgement from the station called, step 412 receives and stores the subsequent data which is sent by the called station. Step 414 then sets an appropriate flag which effectively places the program 270 in bid, and the program returns to the interrupted program at 410.

Figure 12:
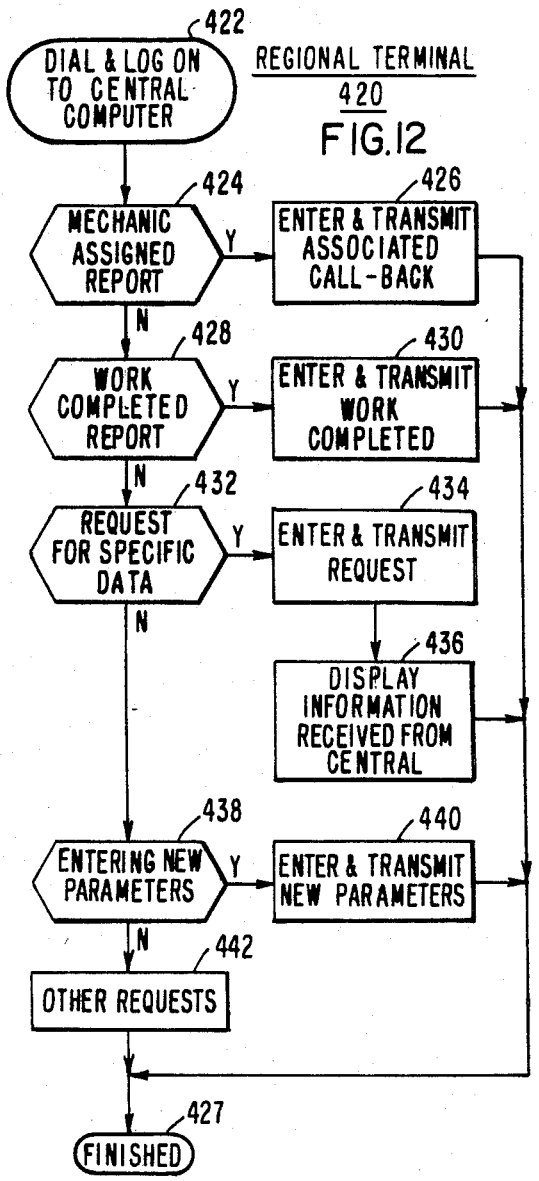
FIG. 12 is a flow chart of the functions which may be performed on the computer terminal located at the regional service office.

FIG. 12 is a functional diagram in the form of a program 420 which illustrates the capabilities of the computer terminal 154 located at the regional office 12. Step 472 dials and logs on to the central computer 62. If the regional office 12 wishes to send a Mechanic Assigned Report, indicated at step 424, step 426 enters and transmits the associated callback so the central computer can remove the callback (step 316—FIG. 7B) from the CBR (RAM map 476—FIG. 15). If the regional office 12 wishes to send a Work Completed Report, indicated in step 428, step 430 enters and transmits the WCR to the central computer 142, so the central computer can update the MDL and CBS, and reset the associated usage data (step 320—FIG. 7B). A request for special data is recognized at step 432, step 434 enters and transmits the request to the central computer 62, and step 436 receives the requested data from the central computer 62 and displays it on display 156. Step 438 identifies a request to enter new parameters, and step 440 enters and transmits the new parameters to the central computer 62. Step 442 recognizes and implements other requests, with step 427 indicating the end of the function list.

Figure 13:
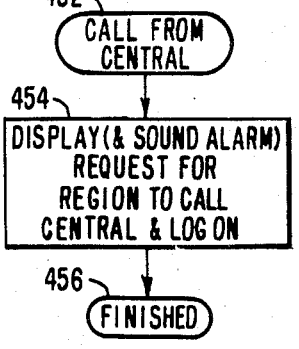
FIG. 13 is a flow chart which indicates the functions provided by the computer terminal at the regional service office when it is called by the central computer.

FIG. 13 is a functional diagram 450 illustrating a phone call from central computer 62 to the regional office 12. The phone call from the central computer 62 is illustrated at 452, and in response thereto, the computer terminal 154 at the regional service office 12 displays a request for the regional office to dial and log on to the central computer 62. An alarm may also be sounded at the regional office 12, in addition to displaying the request.

In summary, there has been disclosed new and improved methods and apparatus for optimizing the service of an elevator system. Instead of scheduling preventive maintenance according to elapsed calendar time, scheduled preventive maintenance is scheduled according to actual usage of the various elevator cars and components of an elevator system. The various components and functions of an elevator system have threshold and limit usage parameters, with items being added to a Maintenance Due List whenever their usage has exceeded the associated threshold parameter. When any item on the list reaches the limit usage parameter, the regional service office is automatically notified that preventive maintenance should be scheduled for all items on the Maintenance Due List, which list is sent to the regional service office. The elevator system is also continuously monitored to detect selfcorrecting malfunctions, to detect deterioration of performance, and to detect failure of those items which can cause failure of elevator service. When any of these items requires the immediate attention of a mechanic, a callback is immediately initiated from the elevator site or from a central computer, requesting that a mechanic be immediately dispatched to the elevator site. The nature of the problem is also sent along with the callback, in considerable detail, to reduce the troubleshooting time on the part of the mechanic. The Maintenance Due List is also given to the mechanic on each callback, even though no item on the list may have reached the limit parameter which triggers scheduled preventive maintenance. The mechanic reports the work actually performed and the usage data for the serviced items is reset to zero. A permanent callback list is maintained for future reference. In addition to optimizing the preventive maintenance of an elevator system, the present invention continuously maintains the operation of an elevator system at peak efficiency because it detects the very start of any degradation of service, enabling it to be promptly corrected, long before it deteriorates to the point where it would come to the attention of the users or building management.

We claim as our invention:

1. A method of improving the servicing of an elevator system by determining when specific preventive maintenance services are due, and when such maintenance services should be scheduled, comprising the steps of:

monitoring the usage of predetermined elevator system functions, collecting usage data in response to the monitoring step, establishing predetermined usage parameters, including both maintenance due thresholds and upper usage limits, for at least certain of the monitored functions, comparing said usage data with the associated parameters, placing at least on maintenance required service on a maintenance due list as the usage of the monitored function reaches the associated maintenance due threshold parameter, and indicating a need for scheduled elevator service, for all of the maintenance services on the maintenance due list, when the usage of one of the monitored functions reaches its associated upper usage limit.

2. The method of claim 1 wherein the step of adding a maintenance service to the maintenance due list when a monitored function reaches its associated threshold parameter, includes the step of storing a list of maintenance services associated with each monitored function, listing specific maintenance services related to the usage of the monitored function, with the maintenance services on the list being added to the maintenance due list when its associated monitored function reaches its associated first parameter.

3. The method of claim 1 including the step of checking the maintenance due list, prior to the step of indicating a need for scheduled elevator service, and adding to the maintenance due list services which may not be due according to usage but which are uniquely related to the performance of the services already on the maintenance due list.

4. The method of claim 3 wherein the step of adding the uniquely related services to the maintenance due list includes the step of preparing a list of items related by the requirements of using the same special tool.

5. The method of claim 3 wherein the step of adding the uniquely related services to the maintenance due list includes the step of preparing a list of services related through a common preparation for their performance.

6. The method of claim 3 wherein the step of adding the uniquely related services to the maintenance due list includes the step of preparing a list of services related by requiring a common access for their performance.

7. The method of claim 3 wherein the step of adding the uniquely related services to the maintenance due list includes the step of preparing a list of services related by requiring a mechanic with a special skill.

8. The method of claim 1 including the step of resetting the usage data associated with the monitored functions after the related services have been performed.

9. The method of claim 1 including the steps of indicating when the services on the maintenance due list have been performed, making a permanent record of the services performed, and resetting the associated usage data.

10. The method of claim 1 including the step of monitoring the status of items which can cause the shutdown of at least part of the elevator system, and indicating the need for immediate elevator service when the status of such an item indicates such a possible shutdown, and wherein the step of indicating the need for immediate elevator service includes the step of reporting all of the services on the maintenance due list as maintenance services which should also be performed when the item which triggered the immediate need is serviced.

11. The method of claim 1 including the step of detecting predetermined self-correcting malfunctions, setting predetermined parameters relative to the self-correcting malfunctions, indicating the need for immediate elevator service when a predetermined self-correcting malfunction exceeds its associated parameter, and including the step of reporting all of the services on the maintenance due list as maintenance services which should also be performed when the self-correcting malfunction which triggered the immediate need is serviced.

12. The method of claim 1 including the step of measuring the performance of predetermined elevator system functions, providing performance parameters for at least certain of the measured performances, indicating the need for immediate elevator service when the measured performance of an element fails to satisfy the associated performance parameter, and including the step of reporting all of the services on the maintenance due list as maintenance services which should also be performed when the element which triggered the immediate need is serviced.

13. A method of improving the servicing of an elevator system by determining when preventive maintenance is due, when preventive maintenance should be scheduled, and when immediate service is required, comprising the steps of:

monitoring the usage of predetermined elevator system functions, collecting usage data in response to the monitoring step, establishing predetermined usage parameters, including both usage thresholds and upper usage limits, for at least certain of the monitored functions, comparing said usage data with the associated parameters, placing predetermined maintenance services on a maintenance due list associated with a monitored function reaching its threshold parameter, monitoring the status of predetermined items of the elevator system which can cause shutdown of at least a portion thereof, reporting the need for scheduled maintenance service, for all of the items on the maintenance due list when the usage of a monitored function reaches its associated upper usage limit, and reporting the need for immediate elevator service when the status of an item which can cause shutdown indicates a possible shutdown, with this step also including the step of reporting all maintenance services on the maintenance due list as maintenance services which should also be performed.

14. A method of improving the service of an elevator system by determining when preventive maintenance is due, when preventive maintenance should be scheduled, and when immediate service is required, comprising the steps of:

monitoring, on-site, the usage of predetermined elevator system functions, collecting, on-site, usage data in response to the monitoring step, sending the usage data to a central computer, establishing predetermined usage parameters for the central computer, including both usage thresholds and upper usage limits, for at least certain of the monitored functions, comparing said usage data with the associated parameters, placing predetermined maintenance services on a maintenance due list when a monitored function reaches the associated threshold parameter, monitoring, on-site, the status of predetermined items of the elevator system which can cause shutdown of at least a portion thereof, reporting from the site of the elevator system to the central computer the need for immediate elevator service when the status of an item which can cause shutdown indicates a possible shutdown, and reporting from the central computer to a maintenance scheduling function: (a) the need for scheduled preventive elevator service, for all of the services on the maintenance due list, when the usage of a monitored function reaches its associated upper usage limit, and (b) the need for immediate elevator service in response to receiving the reporting of such a need from the elevator system site, with this step also including the step of reporting all maintenance services on the maintenance-due list as maintenance services which should also be performed.

15. The method of claim 14 including the step of reporting to the central computer when the need for immediate elevator service has been satisfied, and making a permanent record of the need and the actions taken to satisfy the need.

16. The method of claim 13 including the steps of reporting from the maintenance scheduling function to the central computer when maintenance services on the maintenance due list have been performed, and resetting the usage data at the central computer relative to the services performed.

17. The method of claim 14 including the steps of also sending the maintenance due list from the central computer to the elevator system site, reporting from the elevator system site when services on the maintenance-due list have been serviced, making a permanent record of the services performed, and resetting the usage data at the central computer relative to each such service.

18. The method of claim 14 including the step of monitoring the elevator system on-site for predetermined self-correcting malfunctions, storing the data relative to the detection of such malfunctions on-site, establishing predetermined parameters relative to the malfunctions, comparing the stored data with said predetermined parameters, indicating to the central computer the need for immediate elevator service when a predetermined self-correcting malfunction exceeds its associated parameter, and including the step of reporting this need for immediate service, as well as all of the items on the maintenance due list, from the central computer to the maintenance scheduling function.

19. The method of claim 14 including the step of monitoring the elevator system on-site for predetermined self-correcting malfunctions, sending data relative to the detection of such malfunctions to the central computer, providing predetermined parameters relative to the malfunctions, comparing the data with the predetermined parameters, reporting from the central computer to the maintenance scheduling function the need for immediate elevator service when a predetermined self-correcting malfunction exceeds its associated parameter, and wherein the reporting step also includes the reporting of all services on the maintenance due list as maintenance services which should also be performed when the item which triggered the immediate need is serviced.

20. The method of claim 14 including the step of monitoring the elevator system on-site for predetermined self-correcting malfunctions, storing data relative to the detection of self-correcting malfunctions at both the elevator system site and at the central computer, providing predetermined parameters relative to the malfunctions at both the elevator system site and at the central computer, comparing the malfunction data with the predetermined parameters at both the elevator system site and at the central computer, indicating the need for immediate elevator service when a predetermined self-correcting malfunction exceeds the associated parameter, at either the elevator system site or at the central computer, and including the step of reporting the need for immediate elevator service to the maintenance scheduling function, with this reporting step including the step of reporting the services on the maintenace-due list as maintenance services which should also be performed when the item which triggered the immediate need is serviced.

21. The method of claim 14 including the step of developing at the elevator system site data relative to the performance of predetermined elements of the elevator system, providing performance parameters for at least certain of the performances, comparing, on-site, the performance data with the parameters, reporting the need for immediate elevator service from the elevator system site to the central computer when the performance of an element fails to meet the associated performance parameter, and including the step of reporting the need for immediate elevator service from the central computer to the maintenance scheduling function with this reporting step also including the reporting of all of the services on the maintenance due list.

22. The method of claim 14 including the step of developing, on-site, data relative to the performance of predetermined elements of the elevator system, sending the performance data to the central computer, providing performance parameters for at least certain of the measured performances, comparing, at the central computer, the performance data with the performance parameters, indicating the need for immediate elevator service when the performance of an element fails to meet the associated performance parameter, and including the step of reporting to the maintenance scheduling function the need for immediate elevator service, along with reporting all of the services on the maintenance due list.

23. The method of claim 14 including the step of developing, on-site, data relative to the performance of predetermined elements of the elevator system, storing said data on site and at the central computer, providing performance parameters for at least certain of the measured performances, at both the elevator site and at the central computer, comparing, at both the elevator and at the central computer, the performance data with the performance parameters, indicating the need for immediate elevator service when the measured performance of an element fails to meet the associated performance parameter, at either the elevator site or at the central computer, and including the step of reporting the need for immediate elevator service to the maintenance scheduling function, with the reporting step including the step of reporting the services on the maintenance due list as maintenance services which should also be performed when the item which triggered the immediate need is serviced.

24. An elevator system, comprising:

a plurality of elevator cars mounted in a building to serve the floors therein, monitoring means for providing data relative to the usage of predetermined elevator system functions, memory means for storing said usage data, means for providing first and second parameters related to the usage of at least certain of the monitored functions, with said first parameter being a usage threshold which, when reached, indicates that predetermined maintenance services are due, and with the second parameter being an upper usage limit, which, when reached, indicates that maintenance should be scheduled for said predetermined maintenance services, comparison means for periodically comparing said usage data with said first and second parameters, and for indicating when the first and second parameters are reached, means responsive to said comparison means for creating a maintenance due list which includes maintenance services to be performed which are associated with each monitored function whose usage has reached its associated first parameter, and means responsive to the indication that a second parameter has been reached for indicating that maintenance should be scheduled for all of the maintenance services on the maintenance due list.

25. The elevator system of claim 24 wherein the memory means additionally stores specific maintenance services to be performed when a monitored function reaches its associated usage threshold, with these services being related to the usage of the monitored function, and including means adding said maintenance services to the maintenance due list after the associated function reaches its usage threshold.

26. The elevator system of claim 24 wherein the memory means additionally stores maintenance services to be performed when at least certain of the monitored functions reach their associated thresholds, with these services being uniquely related to the performance of the services associated with the items on the maintenance-due list, without regard to whether or not service is due because of actual usage.

27. The elevator system of claim 26 wherein the additional maintenance services are related to the performance of a service on the maintenance due list because the same special tool is required in the servicing thereof.

28. The elevator system of claim 26 wherein the additional maintenance services are related to the performance of a service on the maintenance due list because the preparation for performing the services is similar.

29. The elevator system of claim 26 wherein the additional maintenance services are related to the performance of a service on the maintenance due list because the access is the same.

30. The elevator system of claim 24 including means for reporting when maintenance services have been performed, and means for resetting the usage data associated with the performed elevator services.

31. The elevator system of claim 24 including means for monitoring the status of items which can cause the shutdown of at least a portion of the elevator system, means for reporting the need for immediate elevator service when such a monitored item indicates a possible shutdown, and means for reporting the maintenance services on the maintenance due list along with the reporting of the need for immediate elevator service.

32. The elevator system of claim 24 including means for monitoring the elevator system to detect predetermined self-correcting malfunctions, means for storing data relative to the detection of such malfunctions, means for providing predetermined parameters relative to said malfunctions, means for comparing the stored data with said predetermined parameters, means for reporting the need for immediate elevator service when the stored data and parameters have a predetermined relationship, and means for reporting the maintenance services on the maintenance-due list along with the reporting of the need for immediate elevator service.

33. The elevator system of claim 24 including means for measuring the performance of predetermined elevator system functions, means providing performance parameters, means for comparing the measured performances with the associated parameters, means for reporting the need for immediate elevator service when the measured performances and associated parameters have a predetermined relationship, and means for reporting the maintenance services on the maintenance due list along with the reporting of a need for immediate elevator service.

34. The elevator system of claim 24 including first and second computer means, with the first computer means being located in the building in which the elevator cars are mounted, and means establishing a communication link between said first and second computer means, wherein the memory means includes memories in both said first and second computers, and wherein the means providing the first and second parameters, the comparison means, the means responsive to the comparison means, and the means which indicates that maintenance should be scheduled, are all associated with said second computer means.

35. The elevator system of claim 34 including a computer terminal, means establishing a communication link between the second computer means and the computer terminal, and including means for sending the indication that maintenance should be scheduled from the second computer means to the computer terminal.

* * * * *